United States Patent [19]

Campbell et al.

[11] Patent Number: 4,938,700

[45] Date of Patent: Jul. 3, 1990

[54] ASSEMBLY INCLUDING TWO MEMBERS CAPABLE OF RELATIVE ROTATION AND WITH ELECTRICAL INTERCONNECTIONS THEREBETWEEN

[75] Inventors: Donald A. Campbell, Glasgow; Alexander G. Gillies, Edinburgh; John D. Davidson, Lothian, all of Scotland

[73] Assignee: Ferranti International PLC, United Kingdom

[21] Appl. No.: 362,247

[22] Filed: Jun. 6, 1989

[30] Foreign Application Priority Data

Jun. 8, 1988 [GB] United Kingdom ..... 8813481

[51] Int. Cl.[5] ..... H01R 35/04

[52] U.S. Cl. ..... 439/13; 439/164

[58] Field of Search ..... 439/13-16, 439/162, 164

[56] References Cited

U.S. PATENT DOCUMENTS 3,028,445 4/1962 Hurley ..... 439/13

*Primary Examiner*—Gary F. Paumen

*Attorney, Agent, or Firm*—Kerkam, Stowell, Kondracki & Clarke

[57] ABSTRACT

An assembly is provided including two members capable of relative rotation about a common axis, and with electrical interconnections extending between the two members, the assembly, being for example, part of a gimbal system, wherein the electrical interconnections may be divided into two groups, selected such that, because of the voltages, and/or currents, carried by the electrical interconnections, it is desired that the electrical interconnections of one group are screened electrically from the electrical interconnections of the other group, by a screen which does not extend along the whole length of either group. An annulus-defining, rotatable, member is provided which is closed at one end, between radially inner and outer, constituent member sections, and a second, fixed, hollow, cylindrical member divides the annulus into radially inner and outer constituent sections, wherein a tape, comprising one group of electrical interconnections, extends between the intermediate member and the outer member section; and another tape, comprising the other group of electrical interconnections, extends between the intermediate member and the inner member section; the two tapes being loosely coiled, in the same direction, in the associated inner and outer annular sections, the assembly being so constructed and arranged that the tapes are screened electrically from each other by the intermediate member.

4 Claims, 3 Drawing Sheets

ASSEMBLY INCLUDING TWO MEMBERS CAPABLE OF RELATIVE ROTATION AND WITH ELECTRICAL INTERCONNECTIONS THEREBETWEEN

BACKGROUND OF THE INVENTION

This invention relates to an assembly which includes two members capable of relative rotation about a common axis, and with electrical interconnections extending between the two members. Usually the two members are restricted to a limited range of relative rotation therebetween.

The assembly may be included in, for example, a gimbal system, a plurality of such assemblies being associated individually with each possible axis of rotation of the gimbal system.

Problems occur when the electrical interconnections extending between the two members are required to carry both power supplies, having associated therewith large voltage transients; and small amplitude signals. Thus, it is desirable to provide electrical screening for the interconnections, to reduce the effects both of cross-coupling between the interconnections, and of locally generated magnetic fields, on the signals.

It is known to employ cablewinders, or slip rings, in such assemblies, but there are mechanical constraints in relation to the use of both these types of devices when screened. Screened cablewinders have high operational torques associated therewith; and slip rings are difficult to screen effectively.

Tapewinders, each having electrical interconnections in the form of a tape (tape cable), are also known in such assemblies, but it is difficult to provide electrical screening along the whole of the lengths of the tapes.

It is an object of the present invention to provide an assembly, including two members capable of relative rotation about a common axis, and with electrical interconnections extending between the two members, which assembly is comparatively easy to construct, and in which assembly the effects both of cross-coupling between the interconnections, and of locally generated magnetic fields, on the signals, are, at least, reduced.

SUMMARY OF THE INVENTION

According to the present invention an assembly includes a member having a radially outer, hollow, cylindrically-shaped section, and secured to one end of the outer section, a radially inner, cylindrically-shaped section, having a longitudinal axis coaxial with the longitudinal axis of the outer section, and being at least substantially coextensive with the outer section along the common longitudinal axis, an annulus being defined between the inner and outer sections, a hollow, intermediate, cylindrically-shaped member having a longitudinal axis coaxial with the longitudinal axis of the inner and outer sections, the two members being mounted for relative rotation about the common longitudinal axis, the intermediate member dividing the annulus into radially inner and outer constituent annular shaped sections, a first tape of electrical interconnections secured at one end to the inner part of the annulus-defining member and secured at the other end to the intermediate member, the first tape being coiled loosely in the inner constituent annular section, a second tape of electrical interconnections secured at one end to the outer section of the annulus-defining member and secured at the other end to the intermediate member, the second tape being coiled loosely in the outer constituent annular section in the same direction as the first tape is coiled in the inner constituent annular section, and the assembly is so constructed and arranged that the two tapes are screened electrically from each other by the intermediate member.

It is required to be able to divide the electrical interconnections into two groups, selected such that, because of the voltages, and/or currents, carried by the electrical interconnections in the operation of such an assembly, the electrical interconnections of one group are desired to be screened electrically from the electrical interconnections of the other group; and each of the two tapes of the assembly is to comprise, individually, one of such two groups of electrical interconnections. With an assembly in accordance with the present invention, as referred to above, because the two groups of electrical interconnections are electrically screened from each other by the intermediate member, it is not necessary to provide a screen which extends along the whole of the length of either group.

BRIEF DESCRIPTION OF THE DRAWINGS

The present invention will now be described by way of example with reference to the accompanying drawings, in which.

DETAILED DESCRIPTION OF THE INVENTION

The illustrated assembly includes two members capable of relative rotation about a common axis, the members being restricted to a limited range of relative rotation therebetween. The assembly may be included in, say, a gimbal system, now shown, a plurality of such assemblies being associated individually with each possible axis of rotation of the gimbal system.

It is required to provide electrical interconnections extending between the two members, the electrical interconnections to carry both power supplies, and small amplitude signals. Inevitably the power supplies have associated therewith large voltage transients. Consequently, it is desirable to provide electrical screening for the interconnections, to reduce the effects both of cross-coupling between the interconnections, and of locally generated magnetic fields, on the signals.

Figure 1:
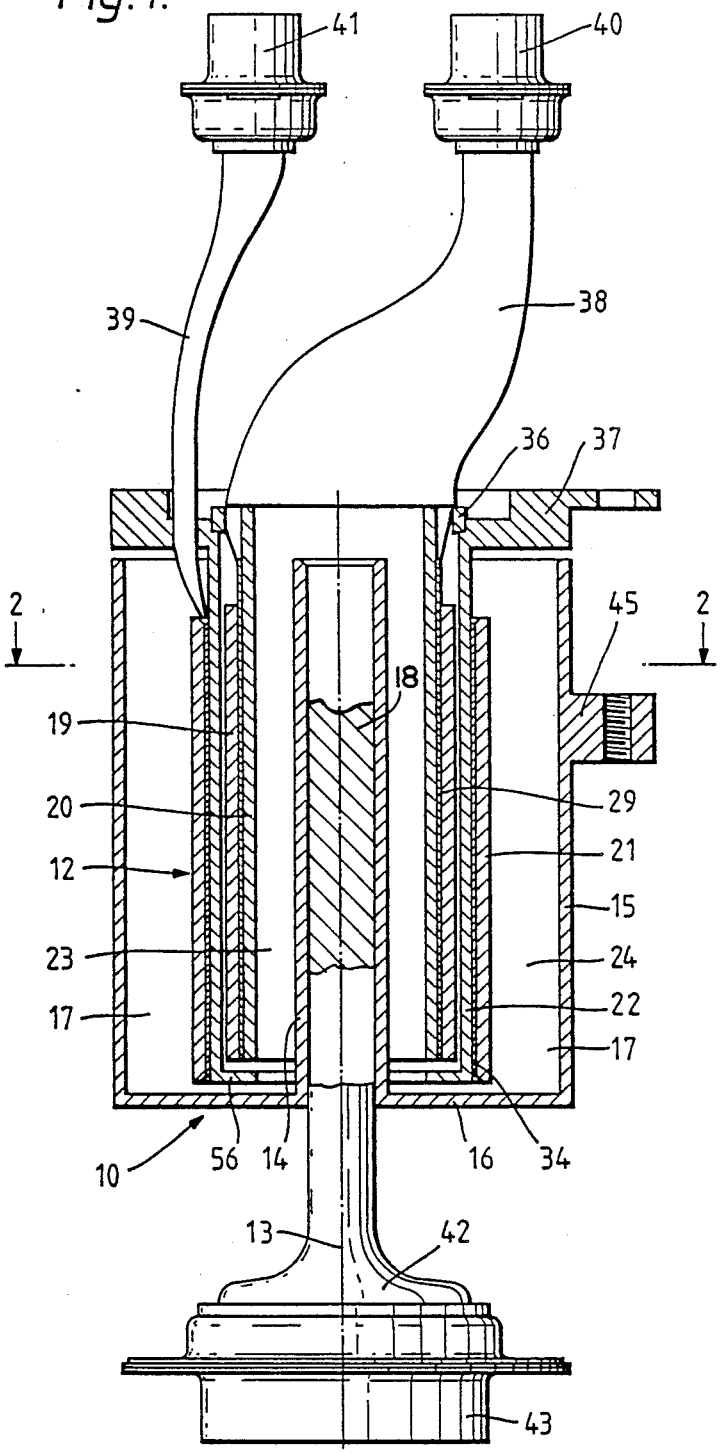
FIG. 1 is a sectional side elevation of one embodiment of an assembly in accordance with the present invention, there being two relatively rotatable members, one member having radially inner, and outer, cylindrically-shaped sections, with an annulus defined therebetween; and the other, intermediate member dividing the annulus into inner, and outer, annular parts; two tapes, each comprising a selected group of electrical interconnections, being loosely coiled, individually, in each of the constituent inner and outer annular parts.

In accordance with the present invention, and as shown in FIG. 1, one member 10, of the two members 10 and 12 capable of relative rotation about an axis 13 indicated in dotted form, comprises a radially inner section 14, and a radially outer section 15. Each constituent section is in the shape of a hollow cylinder, having a longitudinal axis coaxial with the axis 13 of the assembly, and the two sections are joined together at one end 16. The inner and outer sections 14 and 15 coextensive, and define an annulus 17 therebetween. The annulus-defining member 10 is mounted for rotation with an axle 18, shown in FIG. 2, and which axle also is coaxial with the axis 13, the axle extending within, and being secured to, the hollow, cylindrically-shaped, inner section 14 of the member. The other member 12 has a composite construction, comprising four, hollow, cylindrically-shaped sleeves, 19, 20, 21 and 22, secured to each other, and with the longitudinal axis of each sleeve being coaxial with the axis 13. The sleeves are arranged as a radially inner pair 19 and 20, and a radially outer pair 21 and 22. The sleeves, together comprising the member 12, are inserted into the annulus 17, defined between the inner section 14, and the outer section 15, of the member 10. Thus, the member 12, comprising the sleeves, is an intermediate member, dividing the annulus 17 into a radially inner constituent annular section 23, and a radially outer constituent annular section 24. For each pair of sleeves, the radially outer sleeves 19, and 21, are substantially coextensive with both the inner section 14, and the outer section 15, of the member 10; and the radially inner sleeves 20, and 22, extend beyond the annulus 17, remote from the end 16 of the member 10.

Figure 2:
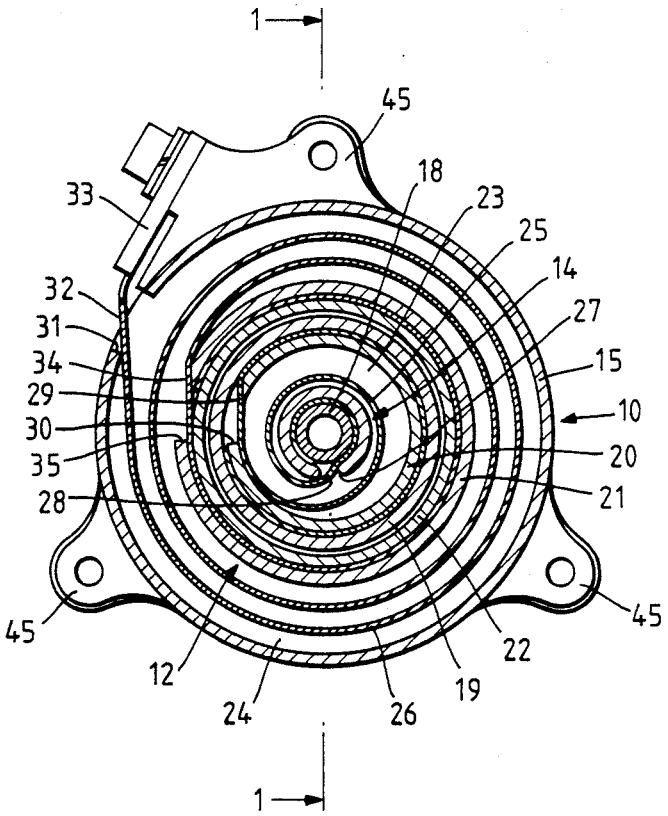
FIG. 2 is of a section on the line 2—2 of FIG. 1, FIG. 1 being of a section on the line 1—1 of FIG. 2.
Figure 3:
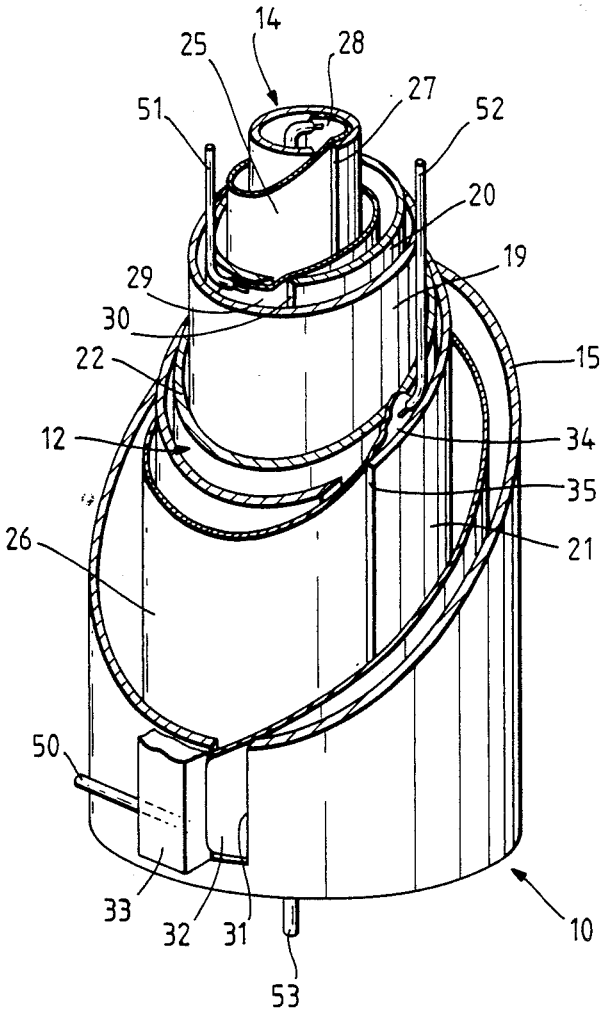
FIG. 3 is a sectioned perspective view of the assembly.

As shown in FIGS. 2 and 3, a tape (tape cable) 25, comprising a group of electrical interconnections, not otherwise shown, is coiled loosely in the inner constituent annular section 23 of the annulus 17; and a similar tape (tape cable) 26, also comprising a group of electrical interconnections, is coiled loosely in the outer constituent annular section 24 of the annulus 17. The two tapes 25 and 26 are coiled in the same direction in the annulus 17. The inner tape 25 extends through a longitudinally extending slot 27 in the inner part 14 of the annulus-defining member 10, and the adjacent end 28 of the tape 25 is clamped between the inner section 14 and the axle 18. The other end 29 of the tape 25 extends through a longitudinally extending slot 30 in the inner sleeve 20 of the inner pair of sleeves of the composite intermediate member 12, and is clamped between the inner pair of sleeves 19 and 20. The outer tape 26 extends through a longitudinally extending slot 31 in the outer section 15 of the annulus-defining member 10, and the adjacent end 32 of the tape 26 is clamped by means 33, integral with the outer surface of the outer section 15 of the member 10. The other end 34 of the tape 26 extends through a longitudinally extending slot 35 in the outer sleeve 21 of the outer pair of sleeves of the composite intermediate member 12, and is clamped between the outer pair of sleeves 21 and 22.

As shown in FIG. 1, flanges, respectively, 36 and 37, on the inner sleeves 20 and 22, of each pair of sleeves, are secured together beyond the defined annulus 17. Conductors, indicated partially, and schematically, at 38 and 39, extend from the ends 29 and 34, respectively, of the tapes 25 and 26, also shown in FIG. 1, and, respectively, are secured to the flanges 36 and 37, and extend to fixed connectors, respectively, 40 and 41. Thereby the fixed conductors 38 and 39, and the fixed connectors, 40 and 41, hold fixed the composite, intermediate, member 12. The annulus-defining member 10 is capable of rotation, relative to the fixed intermediate member 12, by rotation of the axle 18, shown in FIG. 2, secured to the inner section 14 of the member 10. The fixed conductors 38 and 39, and the fixed connectors 40 and 41, together with the tapes 25 and 26, shown in FIG. 2, also hold the longitudinal axis of the composite intermediate member 12 coaxial with the longitudinal axis 13 of the annulus-defining member 10. Further conductors, also indicated partially, and schematically, at 42, extend substantially parallel to the axle 18, to a connector 43. The connector 43, and the conductors 42, rotate with the axle 18, and the rotatable annulus-defining member 10.

As stated above, the illustrated assembly is included in a gimbal system, not otherwise shown. The outer surface of the outer section 15, of the annulus-defining member 10 of the assembly, is provided with three integral lugs 45, as shown in FIG. 2, the lugs being secured to a gimbal frame for rotation therewith. Thus, both the clamping means 33, and the connector 43 shown in FIG. 1, rotate with the gimbal frame, and are arranged to receive electrical connections associated with the gimbal frame. These electrical interconnections associated with the gimbal frame rotate with the gimbal frame, and are for the supply of power, and small amplitude signals, to parts associated with the gimbal frame, and rotating therewith. Hence, the supplies of power, and small amplitude signals, either are carried via the fixed connector 40, fixed conductors 38, inner tape 25, rotating conductors 42, and rotating connector 43, to the gimbal; or are carried via the fixed connector 41, fixed conductors 39, outer tape 26, and rotating clamping means 33, to the gimbal.

Shown in FIG. 3 are leads extending from the connectors 40, 41 and 43, not shown in FIG. 3, and from the clamping means 33, to the sections associated with the gimbal. Lead 50 extends from the rotating clamping means 33; lead 51 extends from inner tape 25 to the fixed connector 40; lead 52 extends from the outer tape 26, to the fixed connector 41; and lead 53 extends to the connector 43 rotating with the gimbal. Leads 51, 52, and 53 are depicted, are representative examples of the ends of conductors 38, 39, and 43, respectively.

The gimbal frame, and hence also the rotatable member 10 of the assembly, is permitted only a limited rotation relative to the fixed, intermediate, member 12, say $\pm 130°$. The assembly is arranged to be such that such limited relative rotation of the gimbal frame, and the member 10, whilst causing the tapes 25 and 26 to tighten, and to slacken, does not cause the tapes to become taut, nor to be so loose as to cause the assembly to operate in an unsatisfactory manner.

The power supplies, say for stepper motors, inevitably have associated therewith large voltage transients, for example, of the order of 50 volts per microsecond. Within the illustrated assembly, it is desirable to provide electrical screening between the electrical interconnections carrying such power supplies, and the electrical interconnections carrying small amplitude signals, to reduce the effects both of cross-coupling therebetween, and of locally generated magnetic fields, on the signals. Thus, as is required for a construction of an assembly in accordance with the present invention, the electrical interconnections are capable of being divided into two groups, one group to carry power supplies, and the other group to carry small amplitude signals. Electrical interconnections which extend between members capable of relative rotation are difficult to screen electrically from each other. This problem is overcome, in an assembly in accordance with the present invention, by these electrical interconnections being provided by the two tapes 25 and 26, and each of the two groups of electrical interconnections required to be screened from each other comprises a tape. The tapes are arranged to be screened electrically from each other by the fixed, composite, intermediate member 12 of the assembly. To enhance the screening, the inner sleeve 22, of the outer pair of sleeves 21 and 22, of the composite, intermediate member 12, is provided with a radially inwardly extending flange 56 adjacent to the end 16 of the annulus-defining member 10, and with the flange 37 at the opposite end of the sleeve 22, extending radially outwardly. Electrical magnetic interference seals, not shown, are also provided.

Hence, the illustrated assembly has a comparatively simple construction, but provides the required electrical screening between two selected groups of electrical interconnections of the assembly.

We claim:

1. An assembly comprising an annulus-defining member having an outer, hollow, cylindrically-shaped section, and secured to one end of the outer section, an inner, cylindrically-shaped section having a longitudinal axis coaxial with the longitudinal axis of the outer section and being at least substantially coextensive with the outer section along the common longitudinal axis, an annulus being defined between the inner and outer sections, a hollow, intermediate, cylindrically-shaped member having a longitudinal axis coaxial with the longitudinal axis of the inner and outer sections, the two members being mounted for relative rotation about the common longitudinal axis, the intermediate member dividing the annulus into radially inner and outer constituent annular shaped sections, a first tape cable secured at one end of the inner section of the annulus-defining member, and secured at the other end to the intermediate member, the first tape cable being coiled loosely in the inner constituent annular section, a second tape cable secured at one end to the outer section of the annulus-defining member, and secured at the other end to the intermediate member, the second tape cable being coiled loosely in the outer constituent annular section in the same direction as the first tape cable is coiled in the inner constituent annular section, the assembly being so constructed and arranged that the two tape cables are screened electrically from each other by the intermediate member.

2. An assembly as claimed in claim 1, in which the intermediate member is fixed, and the annulus-defining member is rotatable.

3. An assembly as claimed in claim 1, in which the intermediate member is provided at either end with radially extending flanges.

4. An assembly as claimed in claim 1, in which the intermediate member has a composite construction comprising a plurality of hollow cylindrically-shaped sleeves secured to each other, with said tape cables being clamped between the sleeves.

* * * * *